United States Patent [19]

Woinarski

[11] 4,256,240

[45] Mar. 17, 1981

[54] CONTAINER CLOSURE

[75] Inventor: Peter A. Woinarski, Woollahra, Australia

[73] Assignee: Innovative Design Company Pty. Limited, Woollahra, Australia

[21] Appl. No.: 87,399

[22] Filed: Oct. 22, 1979

[30] Foreign Application Priority Data

Nov. 1, 1978 [AU] Australia ..... PD6601

[51] Int. Cl.[3] ..... B65D 43/10; B65D 21/02

[52] U.S. Cl. ..... 220/306; 206/508

[58] Field of Search ..... 206/508; 220/306

[56] References Cited

U.S. PATENT DOCUMENTS

| | | | |
|---|---|---|---|
| 2,978,142 | 4/1961 | Novick | 206/508 |
| 3,307,739 | 3/1967 | Cloyd | 206/508 |
| 3,409,123 | 11/1968 | McCormick | 220/306 |
| 3,519,163 | 7/1970 | Bardell | 206/508 |
| 3,840,144 | 10/1974 | Dry | 220/306 |
| 3,954,178 | 5/1976 | Mason | 206/508 |

FOREIGN PATENT DOCUMENTS 435466 2/1971 Australia .

*Primary Examiner*—George E. Lowrance
*Attorney, Agent, or Firm*—Kirschstein, Kirschstein, Ottinger & Cobrin

[57] ABSTRACT

A plastics material closure for attachment to the rim of a container.

The closure has a central well, an inverted first channel which borders the well, a non-inverted second channel that borders the first channel and an inverted third channel which borders the second channel and which is configured to seat on a ledge of a container to which the closure is intended to be fitted.

Wall portions of the first channel are interconnected so as to provide the closure with rigidity sufficient to permit the stacking of closure-fitted containers, but the wall portions of the second channel being free to move one relative to the other whereby the closure is provided with a capacity to flex under impact.

9 Claims, 5 Drawing Figures

FIG. 1
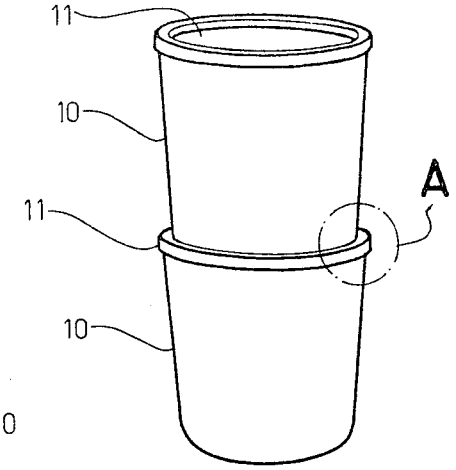
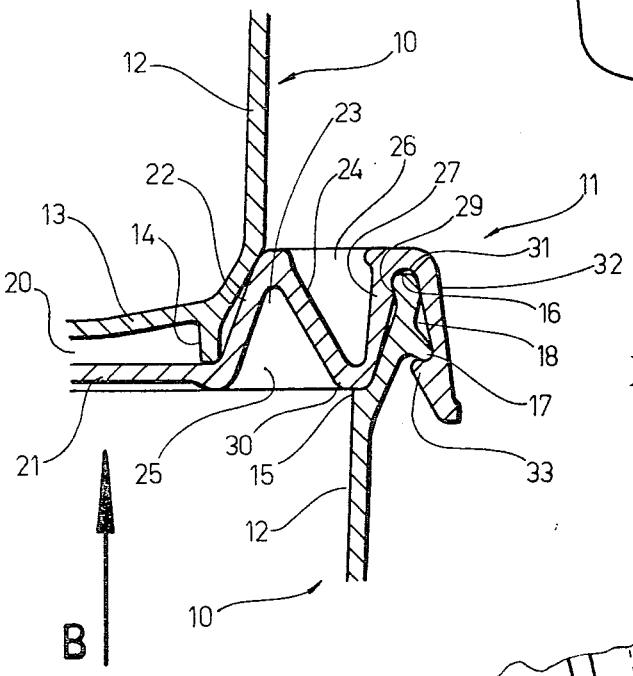
FIG. 2
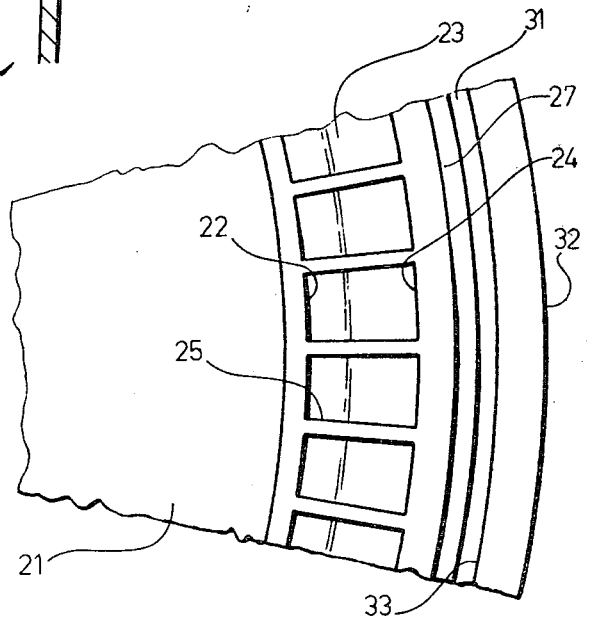
FIG. 3

CONTAINER CLOSURE

FIELD OF THE INVENTION

This invention relates to a plastics material closure for attachment to the rim of a plastics material container.

BACKGROUND OF THE INVENTION

The achievement of an ideal container closure requires application of seemingly conflicting design criteria. Thus, a closure must be configured to engage in positive sealing relationship with the rim of its container and yet be capable of relatively convenient removal. Also, the closure must possess sufficient flexural capacity to absorb impact forces (from any direction) which are likely to be encountered in service, without the sealing relationship being broken, and yet be sufficiently rigid to support static loads imposed by stacking of loaded containers.

Australian Patent Specification No. 435,466 (W.H. Roper et al) discloses a container-closure arrangement which, apparently, meets some but not all of the above requirements. The referenced patent specification describes one structure in particular (see FIG. 8 of the drawings of the patent specification) which provides for sealing of the closure to the rim of the container and for transfer of a static load from the closure to the wall of the container, the load transfer being provided for by a channel portion of the closure engaging in compression against a ledge portion of the container wall. The load transfer effect is enhanced by the walls of the channel being interconnected by radially extending ribs, but it is thought that these must have the effect of reducing the capacity of the structure to withstand impact forces without the closure-to-container seal being broken.

OBJECT OF THE INVENTION

The present invention seeks to provide a closure for a container and which is configured to accommodate the application of impact forces as well as providing static load carrying capacity.

SUMMARY OF THE INVENTION

In broad terms, the present invention provides a closure for a container which has a rim surrounding its opening and a ledge forming a portion of the internal wall of the container. The closure is formed from a resilient plastics material and comprises:

a central well having a base and a bordering wall, an inverted first channel which is at least substantially annular and which borders the well, the first channel having a radially inner wall which constitutes the peripheral wall of the well, a radially outer wall, and means interconnecting the inner and outer walls, a non-inverted annular second channel bordering the first channel, the second channel having a radially inner wall which is constituted by the outer wall of the first channel and a radially outer wall, and the second channel having a base portion which is arranged to seat on the ledge of the container when the closure is fitted to the container, an inverted annular third channel bordering the second channel and arranged to receive the rim of the container, the third channel having a radially inner wall which is constituted by the outer wall of the second channel and a radially outer wall which surrounds the rim of the container when the closure is fitted to the container.

The closure in accordance with the invention and as above defined is characterized by the provision of the two (first and second) mutually inverted channels in addition to the container rim-receiving (third) channel, with the walls of the first channel being interconnected. The means which interconnect the two walls of the first channel may comprise radially extending ribs.

The first channel may be continuous, in which case it would be partitioned by a series of said radially extending ribs, or it may be discontinuous. In the latter case, the first channel would be constituted by at least two and preferably four or more circumferentially aligned trough-like inverted channel segments.

An important feature of the closure of the present invention is that the second (non-inverted) channel does not incorporate any radially extending elements such as ribs interconnecting its walls and hence the walls of that channel may flex toward and away from one another should the closure be subjected to radially directed impact forces.

The invention will be more fully understood from the following description of two explemplary embodiments of container-closure arrangements. The description is given with reference to the accompanying drawings.

DESCRIPTION OF DRAWINGS

In the drawings, FIG. 1 shows a perspective view of two stacked container-closure assemblies, FIG. 2 shows a sectional elevation view of the portion of the container-closure assembly which is encircled in FIG. 1 and identified by the arrow A, the Figure illustrating a first embodiment of the invention, FIG. 3 shows a view of a portion of the underside of the closure which is illustrated in FIG. 2, as viewed in the direction of arrow B.

DETAILED DESCRIPTION OF EMBODIMENTS OF THE INVENTION

FIG. 1 of the drawings shows two containers 10, each of which is fitted with a closure 11. The containers 10 each have a wall which is slightly conical and the base of the upper container nests within a well of the closure of the lower container.

Figure 4:
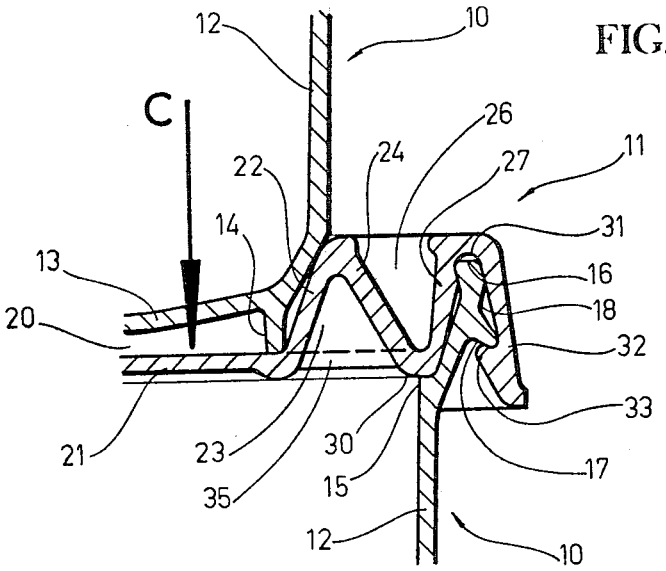
FIG. 4 shows a view which is similar to that shown in FIG. 2, but illustrating a second embodiment of the invention.

As is shown in FIGS. 2 and 4, the container 10 has a surrounding wall 12 and a base 13 which incorporates an integral annular support portion 14.

The upper part of the wall 12 incorporates an inwardly directed annular ledge 15 and, above the ledge, the wall 12 diverges toward the rim 16 of the container. A beading 17 is provided on the outside of the container wall, above the level of the ledge 15, and the beading connects with the rim 16 of the container by way of a slightly concave portion 18.

Referring now to the closure as shown in FIGS. 2 and 3 of the drawings:

This closure comprises a central well portion 20 having a base 21 and a peripheral wall 22. A first channel 23 having an inverted V-shape borders the well, the channel having a radially inner wall which is constituted by the wall 22 and a radially outer wall 24. The channel 23 is continuous, in the sense that its walls 22 and 24 completely encircle the well 20, but the interior of the channel is partitioned by radially projecting ribs 25. The ribs interconnect the walls 22 and 24 and serve to prevent any change occurring in the angle between the two walls of the channel.

A second channel 26 which has a non-inverted V-shape borders the first channel 23, the second channel having a radially inner wall constituted by the wall 24 and a radially outer wall 27. The second channel is open-topped and it is not formed with any interior ribs.

The wall 27 has a negatively inclined portion which engages with the inner margin of the container rim 16.

Also, the second channel 26 has a base portion 30 which rests on the container ledge 15, this arrangement providing for transfer of loads which are imposed on the closure to the wall 12 of the container.

A third, inverted, channel 31 surrounds the second channel and provides a recess for receiving the rim 16 of the container in sealing interengagement. The third channel has a radially inner wall constituted by the wall 27 of the second channel and a radially outer or peripheral wall 32. The wall 32 is formed with an annular inwardly directed projection 33 which snap-fits below and is trapped by the container beading 17 when the closure is fitted to the container.

Removal of the closure from the container is effected by prising the projection 33 outwardly and upwardly with respect to the container beading 17, this operation being accommodated by the inherent resiliency of the closure material.

Figure 5:
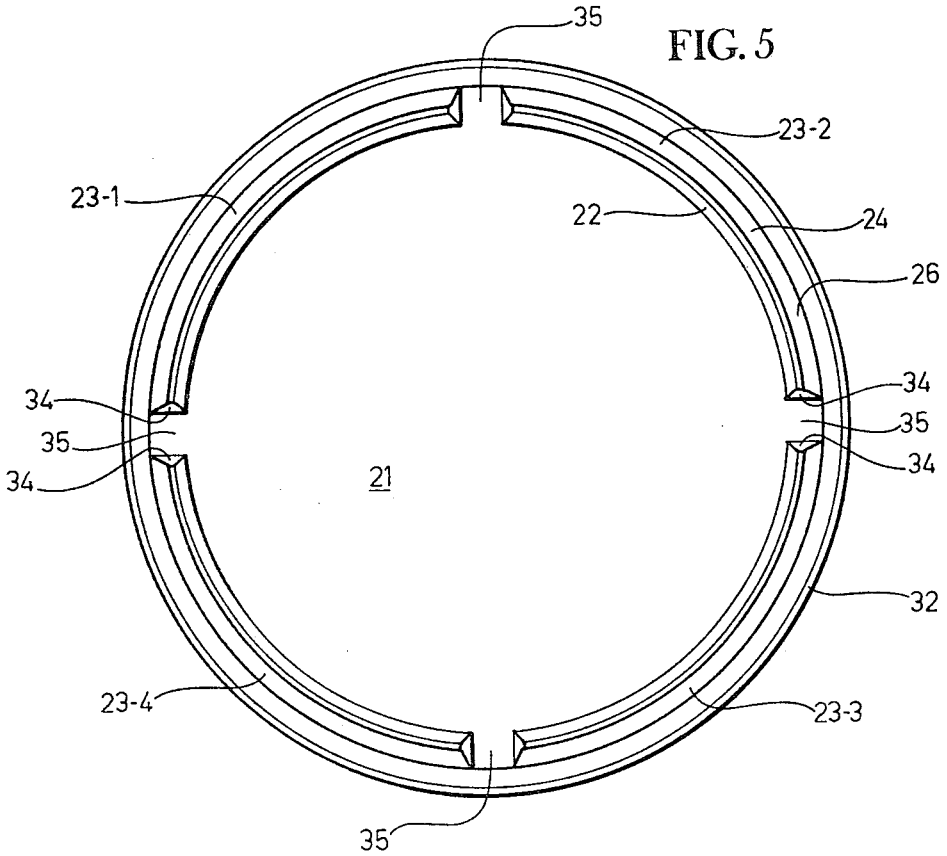
FIG. 5 shows a view of the top side of the closure which is illustrated in FIG. 4, as viewed in the direction of arrow C.

Reference is now made to the closure construction that is shown in FIGS. 4 and 5 of the drawings.

This closure is similar to that which is shown in FIGS. 2 and 3, except that the first (inverted) channel 23 is not continuous and does not (or need not) incorporate radially extending ribs. Instead, the channel 23 is constituted by four circumferentially aligned trough-like channel segments 23-1, 23-2, 23-3, and 23-4 as best seen in FIG. 5. The channel segments are each terminated by end walls 34 which interconnect the channel walls 22 and 24, and a planar bridge 35 extends between the end walls 34 of adjacent channel segments to join the well base 21 to the base 30 of the second channel 26.

Although not so shown in the drawings, each of the channel segments 23-1 to 23-4 may have its walls joined by radially projecting ribs in the same manner as the continuous channel structure as shown in FIGS. 2 and 3.

Also, although the closure as shown in the drawings has four of the channel segments 23-1 to 23-4, six such channel segments are preferably provided.

I claim:

1. A closure for a container which has a rim surrounding its opening and a ledge forming a portion of the internal wall of the container;

the closure being formed from a resilient plastics material and comprising:

a central well having a base and a bordering wall, an inverted annular first channel which borders the well, the first channel having a radially inner wall which constitutes the wall of the well, a radially outer wall, and partitioning means interconecting the inner and outer walls whereby said walls are restrained from moving one relative to the other, a non-inverted annular second channel bordering the first channel, the second channel having a radially inner wall which is constituted by the outer wall of the first channel and a radially outer wall, the outer wall of the second channel being movable relative to the inner wall of the second channel, and the second channel having a base portion at the bottom of the outer wall of the first channel which is arranged to seat on the ledge of the container when the closure is fitted to the container, and an inverted annular third channel bordering the second channel and arranged to receive the rim of the container, the third channel having a radially inner wall which is constituted by the outer wall of the second channel and a radially outer wall which surrounds the rim of the container when the closure is fitted to the container.

2. A closure as claimed in claim 1 wherein the first channel has an inverted substantially V-shaped profile in cross-section.

3. A closure as claimed in claim 2 wherein the second channel has a profile which is substantially V-shaped in cross-section.

4. A closure as claimed in claim 1 wherein said partitioning means interconnecting the inner and outer walls of the first channel comprise radially extending ribs.

5. A closure for a container which has a rim surrounding its opening and a ledge forming a portion of the internal wall of the container;

the closure being formed from a resilient plastics material and comprising:

a central well having a base and a bordering wall, a discontinuous inverted first channel which borders the well and which is constituted by at least two circumferentially aligned trough-like channel segments, the channel segments having a radially inner wall which constitutes the wall of the well and a radially outer wall, and each channel segment being terminated at each end thereof by an end wall which interconnects said inner and outer walls whereby said walls are restrained from moving one relative to the other, a non-inverted annular second channel bordering the first channel, the second channel having a radially inner wall which is constituted by the outer wall of the channel segments of the first channel and a radially outer wall, the outer wall of the second channel being movable relative to the inner wall of the second chnnel, and the second channel having a base portion at the bottom of the wall of the first channel which is arranged to seat on the ledge of the container when the closure is fitted to the container, and an inverted annular third channel bordering the second channel and arranged to receive the rim of the container, the third channel having a radially inner wall which is constituted by the outer wall of the second channel and a radially outer wall which surrounds the rim of the container when the closure is fitted to the container.

6. A closure as claimed in claim 5 wherein each channel segment of the first channel has an inverted substantially V-shaped profile in cross-section.

7. A closure as claimed in claim 5 wherein the second channel has a profile which is substantially V-shaped in cross-section.

8. A closure as claimed in claim 5 wherein a bridge extends between the end walls of adjacent said channel segments, the bridge joining the base of the well to the base portion of the second channel.

9. A closure as claimed in claim 1 or claim 5 in combination with a said container, the container having a beading extending around its rim and the outer wall of the third channel having a radially inwardly directed projection which is arranged to snap fit below the container beading when the closure is fitted to the container.

* * * * *